United States Patent [19]

Cherian et al.

[11] 4,080,032

[45] Mar. 21, 1978

[54] ZERO INSERTION FORCE CONNECTOR

[75] Inventors: Gabriel Boutros Cherian, York; William Samuel Scheingold, Palmyra; LaVern Dale Wulf, Harrisburg, all of Pa.

[73] Assignee: AMP Incorporated, Harrisburg, Pa.

[21] Appl. No.: 787,184

[22] Filed: Apr. 13, 1977

Related U.S. Application Data

[63] Continuation of Ser. No. 720,185, Sep. 3, 1976, abandoned.

[51] Int. Cl.[2] ..... H01R 13/54; H05R 1/10

[52] U.S. Cl. ..... 339/75 M; 339/17 CF; 339/176 MP

[58] Field of Search ..... 339/17 CF, 74 R, 75 M, 339/75 MP, 176 MP

[56] References Cited

U.S. PATENT DOCUMENTS

| | | | |
|---|---|---|---|
| 3,683,317 | 8/1972 | Walkup | 339/75 MP |
| 3,750,085 | 7/1973 | Cooper | 339/17 CF X |
| 3,818,419 | 6/1974 | Crane | 339/176 MP X |

OTHER PUBLICATIONS

IBM Technical Disclosure Bulletin, Ecker, Zero Insertion Force Receptacle for a Planar Circuit Board, June 1974, vol. 17, No. 1, pp. 96-97.

*Primary Examiner*—Roy Lake
*Assistant Examiner*—E. F. Desmond
*Attorney, Agent, or Firm*—Allan B. Osborne; William J. Keating; Jay L. Seitchik

[57] ABSTRACT

The present invention relates generally to a connector of the type for electrically connecting and mechanically retaining an integrated circuit package or other multi-pin devices to a printed circuit board. More particularly the connector contains a number of contact bearing, double arm spring members along either side. To insert a package the inside arms are pulled away from biasing contact with the outer arms by transversely moving two actuating members with a single centrally disposed longitudinally moving draw bar via cooperating ramp and slot configurations.

17 Claims, 9 Drawing Figures

ZERO INSERTION FORCE CONNECTOR

This is a continuation of application Ser. No. 720,185, filed Sept. 3, 1976, now abandoned.

BACKGROUND OF THE INVENTION

1. Field of the Invention

This invention is a connector falling within the art of providing an interconnection between a device having multiple depending pins, such as an integrated circuit package or an electromagnetic relay switch, and a printed circuit board or the like. Further, the invention is in the art of providing a mechanism so that the multi-pin device can be positioned into the connector freely; that is, a driving force is not needed to overcome the high contact pressures of the connector's spring members.

2. Prior Art

Prior art devices of the type in consideration herein is exemplified in U.S. Pat. No. 3,883,207. This type of device or connector supplements individual spring receptacles such as disclosed in U.S. Pat. No. 3,850,500.

Earlier prior art devices which incorporate zero insertion force mechanisms include U.S. Pat. Nos. 3,683,317 and 3,750,085.

In U.S. Pat. No. 3,683,317 a side wall moves down to move one arm of a contact member toward another arm to secure a pin positioned therein.

Zero insertion force is provided for in U.S. Pat. No. 3,750,085 by the cover of the connector flexing the contacts against the pin as it is being pushed into place.

The cover is also used in U.S. Pat. No. 3,883,207. A wedge-shaped depending portion thereon pushes the contacts outwardly against the package pins.

Zero insertion force devices employing sliding cam members are popular in printed circuit board connectors. A simple such device is disclosed in U.S. Pat. No. 3,426,313. The cam, having a ramp and slot configuration on two opposing sides, is positioned between the two arms of the contact members and by sliding it a short distance the arms are spread out to allow the insertion of the board in between.

U.S. Pat. No. 3,555,488 discloses a two member device where each member has a ramp and slot configuration. One slides longitudinally pushing the companion vertically; this moves the contacts into engagement with the board.

SUMMARY OF THE INVENTION

The connector constructed in accordance with the present invention comprises a plurality of double-arm spring members, a base for housing the spring members, and a unique actuating means for pulling or drawing one arm away from the other so that a multi-pin device can be loaded into the connector without requiring any insertion force. The actuating means includes a draw bar having two depending legs which mesh with upstanding legs on U-shaped actuating members. By sliding the draw bar longitudinally, complementary ramp and slot configurations on the meshing legs draws the actuating members in a transverse direction. With the free end of one arm of the spring members hooked to the actuating members, the transverse movement spreads or opens the double arms to permit the force free insertion of the mutli-pin device.

DESCRIPTION OF THE PREFERRED EMBODIMENT

Figure 1:
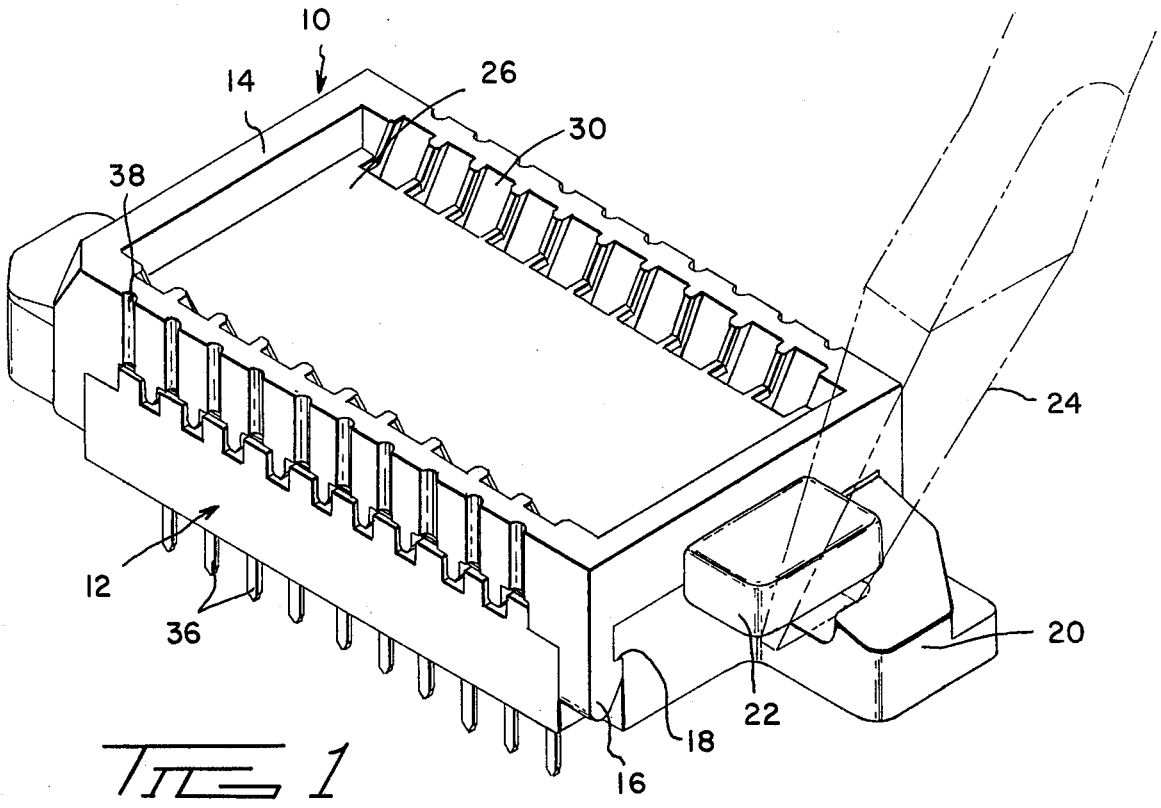
FIG. 1 is a perspective view of the preferred embodiment of a connector constructed in accordance with the present invention.

Connector 10 shown in FIG. 1 has a base 12 and a cover 14. The two are removably latched together by depending fingers 16 on the ends of the cover engaging downwardly facing shoulders 18 on the base. A platform 20 extends outwardly from either end of the base. The platform is a fixed part of the base and provides support for pushing against one of the two ends of draw bar 22 which may be protruding outwardly with the tip of screwdriver 24.

Figure 4:
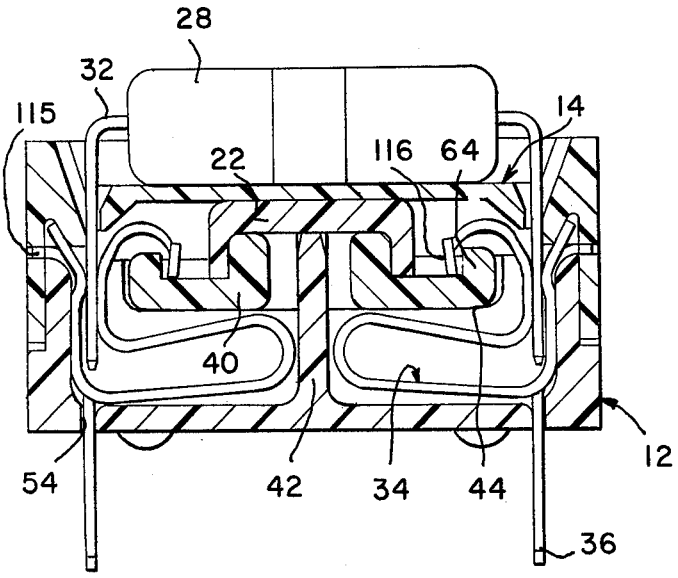
FIG. 4 is a cross-sectional view across the width of the connector shown in its loaded condition.

Cover 14 is recessed as indicated by reference numeral 26 to receive a multi-pin device 28 shown in FIG. 4. Beveled slots 30 extend down the sides of the recess to channel the pins 32 of device 28 into the base and spring members 34 (FIG. 3) contained therein. Pins 36 of those spring members can be seen depending from the base. The semi-rounded grooves 38 on the outer surface of the cover sides provide access to probe areas in the base.

Base 12, cover 14, draw bar 22 and actuator members 40 (FIG. 4) are all preferably molded from high temperature plastic such as RYTON-4made by Phillips Petroleum Company or a low temperature plastic such as thirty percent glass filled VALOX sold under that tradename by General Electric.

Figure 2:
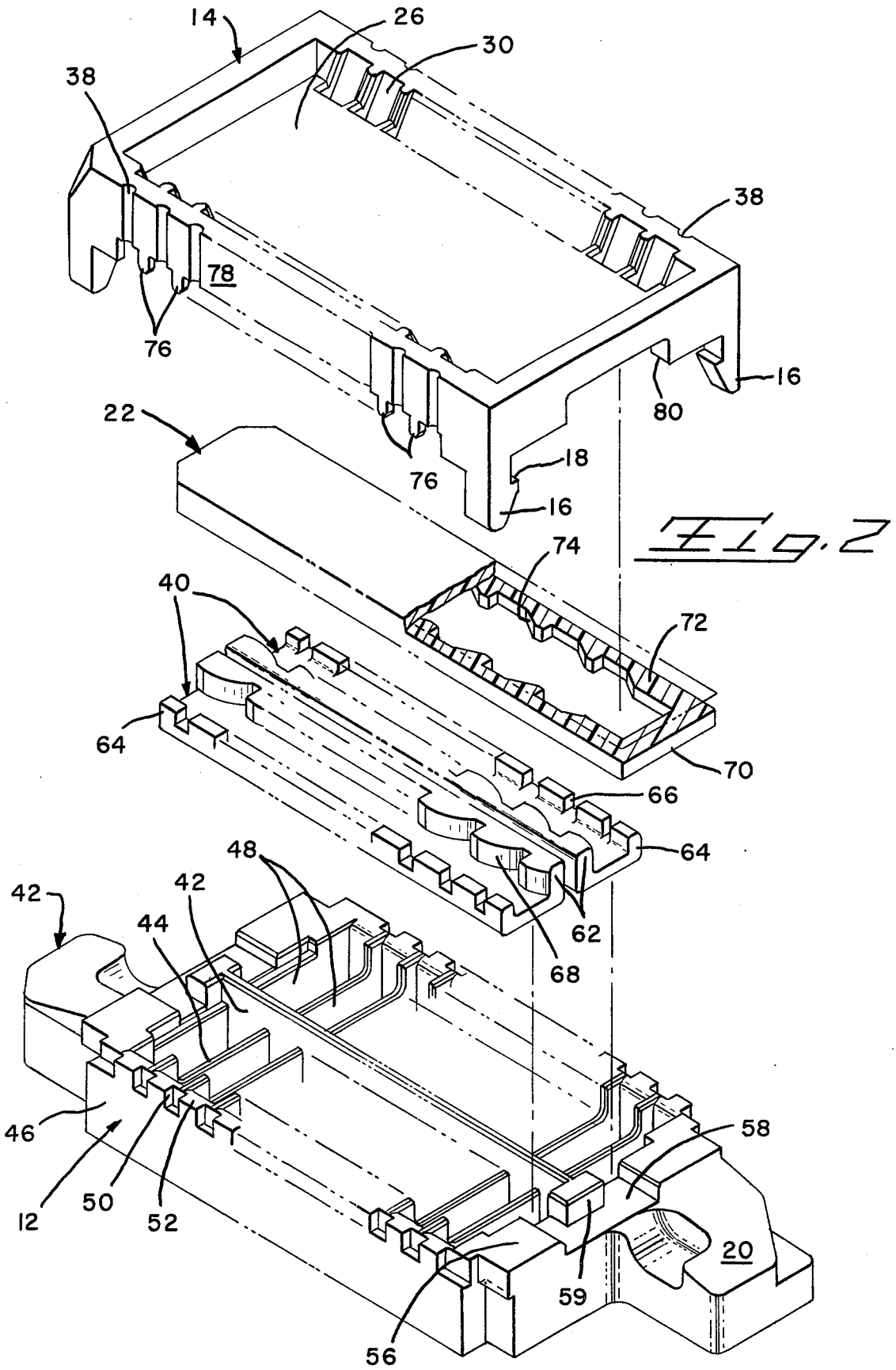
FIG. 2 is an exploded view of the connector of FIG. 1.

FIG. 2 is an exploded view of the connector of FIG. 1 and shows the construction thereof as well as the internal details. Commencing with base 12 it can be seen that the interior is a cavity and has a center wall 42 and a number of transverse walls 44 extending from the side walls 46 to the center wall. Walls 44 define compartments 48. These walls provide one system of support means as well as to define the compartments. A number of notches 50 extend along the top of each side wall; these notches defining probe flats 52, the latter being in line with compartments 48. As seen, the compartments are open at the top and have a pin exit opening 54, seen in FIG. 4, at the bottom adjacent the side walls. The end walls 56 of the base are channeled as indicated by reference numeral 58 to provide a channel for draw bar 22. A stop 59 is provided in the center of each channel so that draw bar 22 cannot be pushed too far in either direction.

Each connector has two actuator members 40, one being on each side of the center wall and movable transversely, riding on top of transverse walls 44 as shown in FIGS. 4, 5 and 7. The actuator members are U or channel shaped with inside legs 62; i.e., those nearest the center wall, and outside legs 64. Notches 66 may be provided in the outside legs as shown to provide clearance for the upper portion of the spring member's second arm. The inside surface of the inside leg has a ramp and slot configuration, generally indicated by reference numeral 68.

Draw bar 22 resembles in cross-section a U or channel shaped member in an inverted position. The ends 70 are closed off to provide an abutting surface for screwdriver 24 (FIG. 1). Both arms or legs 72 have a ramp and slot configuration 74 on their inside vertical surfaces. Draw bar 22 represents one means for transversely moving the actuating members.

Other features of cover 14 in addition to those mentioned elsewhere, include stubs 76 which depend from the side walls 78 and are adapted to nest in notches 50 in the base. A channel 80 is located throughout the cover as seen at each end for draw bar 22. With reference to FIG. 5A, the inside surface of sidewalls 78 have triangular-shaped cavities 82 spaced along the length of the cover, each cavity being in alignment with a compartment 48 when the cover and base are assembled. Further the recessed surface of the cover, reference numeral 84 in FIG. 5A, contains openings 86 to admit pins 32 on device 28 (FIG. 4). Interiorly a wedge-shaped extension 87 juts down to provide alignment means for the pins 32 as the device is being plugged into the connector. Note that the wall of the extension defining opening 86 is beveled to partially complete the funnel approach of slots 30.

The details of the ramp and slot configurations 68 (on the actuator members) and 74 (on the draw bar) will now be set forth with reference primarily to FIG. 5B.

The ramp and slot configuration 68 on the inside surface of actuator leg 62 consists of repeating segments that includes a slot, ramp and dwell portion. Slot 88 is straight or parallel to the outside surface 90 of the leg. The ramp 92 extends from the slot to a dwell portion 94. The ramp describes a curved surface. Dwell portion 94 is angled, the angle being about 5° relative to surface 90. The shoulder 96 defined by the juncture of dwell portion 94 and the next slot 88, is perpendicular to surface 90. The slot 88 and dwell portion 94 occupy about 39 percent of the total segment length; i.e., from one shoulder 96 to the next shoulder.

The ramp and slot configuration 74 on the inside surface of leg 72 (on draw bar 22) also consists of repeating segments comprising a slot, ramp and dwell portion. Slot 98 is parallel to the outside surface 100 of leg 72. Ramp 102, extending from the slot to dwell portion 104, is linear and is at an angle relative to outside surface 100. This is a clearance angle and must be larger than the largest slope angle of ramp 92 on the actuator. The nose at the juncture of ramp 102 and dwell portion 104 is rounded as indicated by reference numeral 105. Dwell portion 104 is angled relative to surface 100; the angle being equal to that of dwell portion 94 on the actuator. Note that 5° is arbitary and as will be seen later, can vary therefrom. In both dwell portions 94 and 104, the angle is reversed relative to ramps 92 and 102; i.e., from the juncture with the ramps, the dwell portions angle toward the outside surfaces. The slot 98 is considerably longer than slot 88 on the actuator member: it and dwell portion 104 occupy about 60% of the segment length; i.e., from one shoulder 106 to the next shoulder 106.

The geometry of the ramp, slot and dwell portion has been designed to provide limited longitudinal travel of the draw bar 22 with a predetermined amount of force. However, before discussing that, it might be well to mention that in the meshing configuration, one side or surface acts as a cam and the other as a follower. In this embodiment, the draw bar, or more precisely, the rounded noses 105, actually plays the role of follower even though it is the member against which the initial force is applied. The reverse condition can be used without any change in effect and operation.

If ramp 92 is made straight; i.e., not curved, the force required to move the draw bar in order to spread spring member arms 110 and 112 (FIG. 5A) apart would be directly proportional to the spring force which in turn is constantly increasing in direct proportion to the arms opening. The exerted force on the draw bar 22 would be intitially low and would gradually increase to a maximum level.

If however, the force to be exerted is to be within a predetermined limit, then the length of travel of the draw bar must be determined accordingly.

If however, both the force is to be a predetermined amount and other parameters such as available real estate on a printed circuit board, connector packing density, etc. require a minimum longitudinal draw bar travel, then the solution must lie with ramp geometry. By shaping the ramp in a curved path so that its slopes varies constantly, the force required initially will quickly reach the predetermined limit and thereafter would remain approximately constant for practical purposes throughout the remaining length of travel. It is now possible to reduce the total travel movement of the draw bar to a fraction of that required if the ramp were straight.

In the preferred embodiment, the curvature of ramp 82 is about 12°, the radii intersecting either end of the ramp being perpendicular to the ends.

Figure 3:
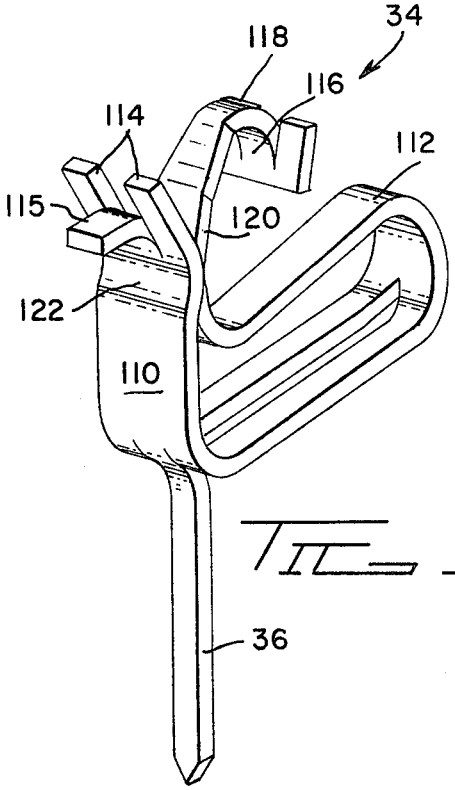
FIG. 3 is a perspective view of the spring member which is part of the present invention.

With reference to FIG. 3, spring member 34 has a first contact arm 110 and second contact arm 112. As is apparent, the spring members are stamped and formed from a coplanar stip of conductive material such as one-half mill hardened beryllium copper and either gold or tin-lead plated.

The first arm has a gentle double curve with its upper portion formed into a pair of retaining prongs 114 and probe finger 115. The aforementioned pin 36 extends downwardly from the first arm; however, as shown, it has been blanked out from a lower portion of the second arm.

Second arm 112 is generally S-shaped with the lower half greatly elongated horizontally to provide high spring capability with high flexibility and without overstressing the material at the same time. The free end is T-shaped as indicated by reference numeral 116. The vertical tabs 118 may be omitted if desired. The bight of the second curve, indicated by reference numeral 120 is in alignment with the upper curve 122 of the first arm.

FIG. 4, a cross-sectional view of connector 10, depicts the connector in an assembled condition and also shows how it receives a multi-pin device 28.

Spring members 34 are placed in each compartment 44 with pins 36 exiting out through openings 54. These depending pins permit the connector to be plugged into a printed circuit board or the like. Also the pins can be bent so that the connector can be surface mounted.

Probe fingers 115 lay on top of probe flats 52. The two actuating members 40 are positioned longitudinally on top of transverse walls 44 and with each T-shaped free end 116 of the spring members located on the inside of legs 64; i.e., in the channel itself.

Figure 5B:
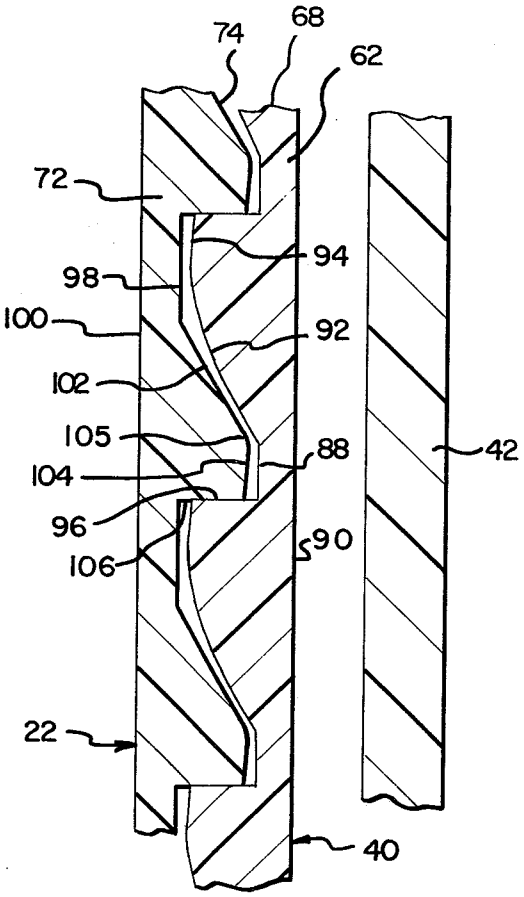
FIGS. 5*a* through 7*b* are action views illustrating the operation of the connector of FIG. 1.
Figure 5A:
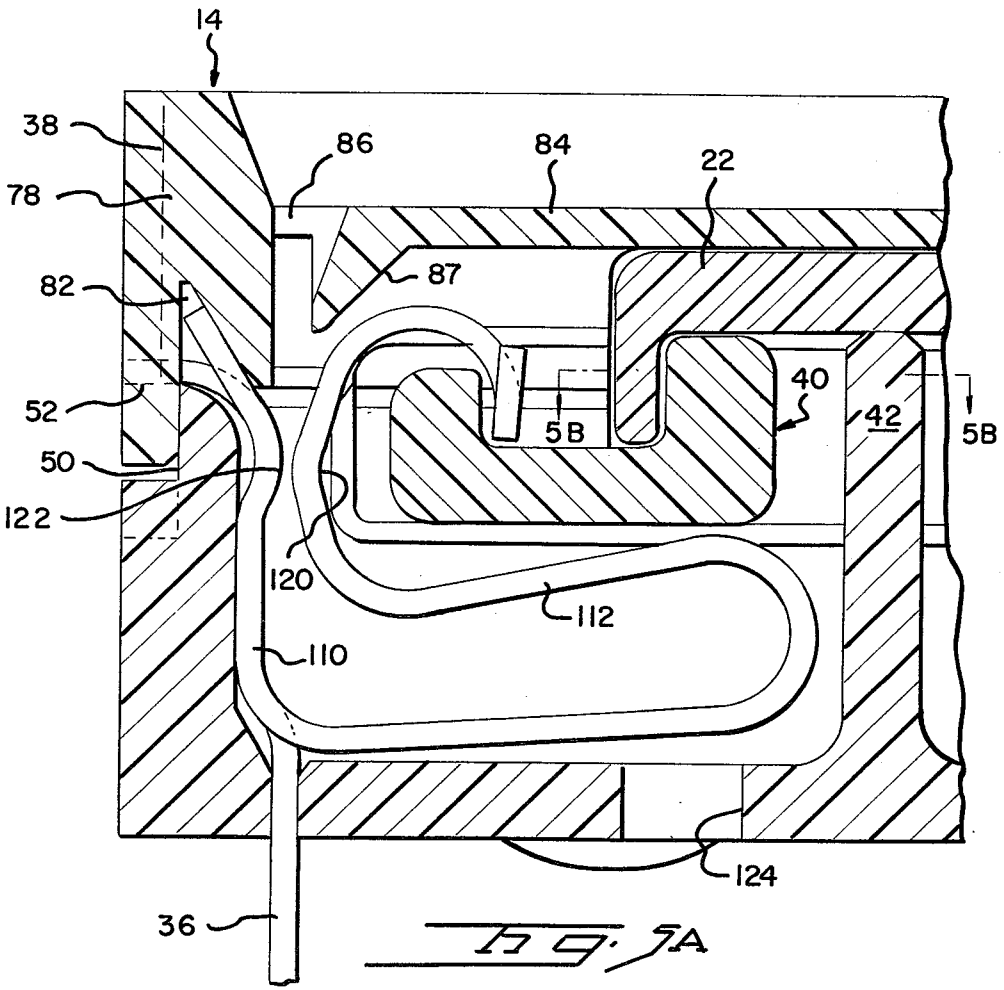

Draw bar 22 is positioned over center wall 42 with each of its legs in the actuator's channels so that the ramp and slot configuration are in a mesh condition as shown in FIG. 5B. The length of the draw bar is such that one end extends out beyond the end walls of the base and cover but within the confines of platform 20.

Cover 14 is placed on the base so that the prongs 114 on each spring member enters into the aligned cavity 82. As the cover is pushed on, force is placed on the spring members through the prongs. This force is transfered through the arms so that the natural resting or static position of the spring members is with the bight 120 on arm 112 and curve 122 on arm 110 tending to close the gap there between. This is illustrated in FIG. 4. In the alternative, the spring members can be preloaded and the cavities serve simply to retain first contact arm 110 horizontally and vertically. Note that the actuators 40 are as far removed from the center wall 42 as possible. This static condition is also shown in FIGS. 5A and 5B. Note also that there is no contact between legs 64 and free end 116 on the spring members.

FIG. 5B is an enlarged drawing of the meshed ramp and slot configurations with the center wall 42 positioned for reference. Only one side is shown; it being understood that the other side is a mirror image thereof.

Figure 6:
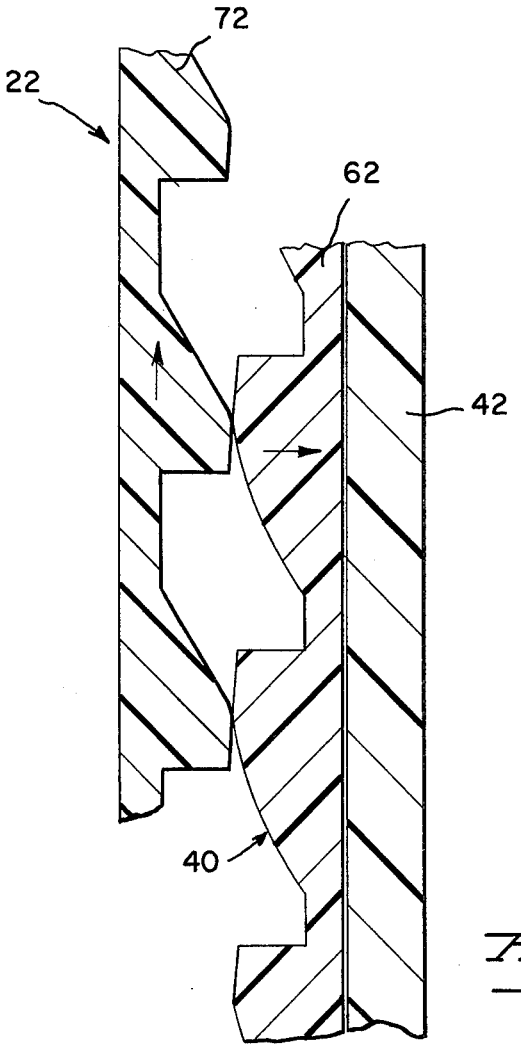
Figure 7B:
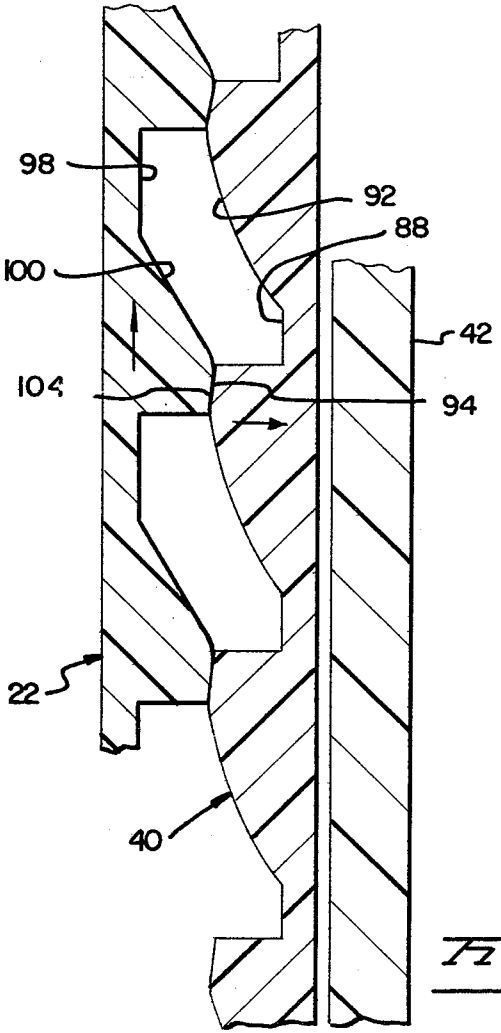

To open the double contact arms, draw bar 22 is moved longitudinally. Interaction of the meshed ramp and slot configurations cause actuator member to move transversely in towards center wall 42, pulling in the second arm 112. Maximum transverse movement of the actuators is achieved prior to the maximum travel of the draw bar. This condition is shown in FIG. 6 where the arrows indicate relative movement. Note that the actuator's inner leg 62 is quite close to center wall 42, but not touching it. Further longitudinal movement of the draw bar brings the corresponding dwell portions 94 and 104 into abutting contact as shown in FIG. 7B. Because both dwell portions are at a reverse angle, there is some return freedom of transverse movement by the actuators. This movement takes place under the tension of the now stressed spring members so that actuators 40 are pulled back away from the center wall 42. The reason for the reverse angle however is to removably lock the actuators and draw bar together to prevent creep due to non-intentional forces such as vibrations.

Figure 7A:
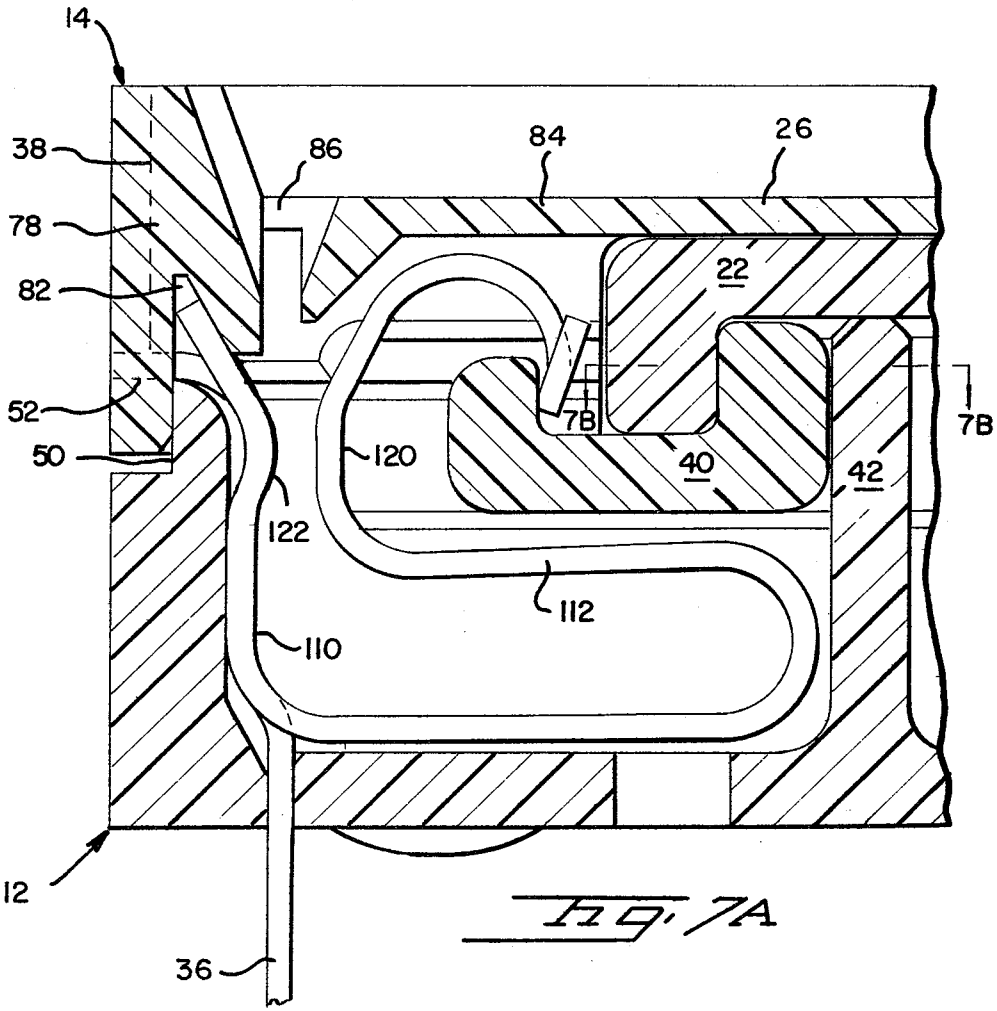

FIG. 7A illustrates the connector in an open position; i.e., device 28 may now be placed therein without the need to apply an insertion force on its normally fragile pins 32.

After the device is inserted, reverse movement of the draw bar 22 frees the actuators which are then returned to FIG. 5A or FIG. 4 position by the tension of spring members 34. As noted above, the two contact arms bear in on both sides of pins 32 of the device 28 with the proper contact pressure.

Although not shown, connector 10 is preferably equipped with keying or polarizing devices to insure error free assembly. Further, the ends of the draw bar may be marked with appropriate legends such as "ON" and "OFF".

The presence of grooves 38 provide access to probe fingers 115 whereby each spring member can be tested without removing a device 28 which may be plugged into it.

An enlarged opening is shown in base 12 in FIG. 5A. This opening 124 allows cleaning solvents an entrance and exit.

The foregoing detailed description has been given for clearness of understanding only, and no unnecessary limitations should be understood therefrom, as some modifications will be obvious to those skilled in the art.

What is claimed is:

1. A connector for receiving a multi-pin electronic device and electrically connecting such to a printed circuit board or the like, which comprises:

a. an elongated base having a center wall extending from one end to the other and a plurality of transverse walls defining narrow compartments extending inwardly from the side walls to the center wall with each compartment being open upwardly and having a small opening through the floor of the base;

b. a pair of elongated channel shaped actuating members having first and second legs, each member positioned longitudinally between a side wall and the center wall and movably resting on the transverse walls, each first leg being adjacent the center wall and having repeating ramp and slot configurations on its channel facing surface;

c. a plurality of spring members, each member having a first arm and a resilient second arm, said first arm being generally straight and the second arm being generally S-shaped with the free end of the upper portion projecting toward the lower portion, said two arms being connected at their lower portions with a pin extending downwardly therefrom for contact with a printed circuit board or the like, said spring members being positioned in the compartments with the pins extending through the small opening in the floor of the base and with the first arms extending upwardly adjacent the inside surface of the side walls and with the lower portion of the second arm extending towards the center wall and the free end of the upper portion extending into the channel of the actuator members; and d. an elongated, inverted channel shaped draw bar having two legs and slidably positioned longitudinally over the center wall with its legs extending into the channels of the actuator members, each leg having on its channel facing surface a repeating ramp and slot configuration which cooperates with the like configuration on the first legs of the actuator members so that as the draw bar slides longitudinally, the actuator members slide transversely whereby in a transverse move towards the center wall the second legs hook the free end of the spring member and draws the second arm away from the first arm so the pins of a multi-pin device may be inserted in between the two arms, and in a transverse move away from the center wall the second arm moves towards the first arm so that the two arms embrace the pins of the multi-pin device which may be positioned therein between.

2. The connector of claim 1 further including covering means for covering the base.

3. The covering means of claim 2 having on its top surface a recessed area for receiving the multi-pin device and openings along each longitudinal side of the recessed area for insertion of the pins on the multi-pin device.

4. The connector of claim 1 wherein the ramp and slot configurations include a slot portion and a dwell portion with a ramp portion therein between, so that the slot and dwell portions are laterally displaced one from the other, said slot portion being parallel to the longitudinal axis of the actuator members and draw bar, and the dwell portion being angled away from the channels.

5. The ramp and slot configurations of claim 4 wherein the angle of the dwell portion is about 5° relative to the longitudinal axis of the actuator members and draw bar.

6. The ramp and slot configurations of claim 4 wherein the ramp portions on the actuator members are curved and the ramp portions on the draw bar are straight.

7. The ramp and slot configurations of claim 4 where the juncture between the ramp portion and dwell portion on the draw bar is rounded.

8. The connector of claim 1 wherein the first arms of the spring members have on the upper portion a probe finger extending laterally towards the side walls and the side walls of the base include receiving flats for said fingers, said flats being accessible from without the connector for permitting electrical probing of said spring members.

9. The connector of claim 2 wherein said covering means include depending side walls having retaining cavities along the inside surfaces thereof and the first arms of the spring members include fingers adapted to be received in the retaining cavities for retaining the spring members in the compartments.

10. The connector of claim 9 wherein an interference between the retaining cavities and the fingers places said spring members in compression.

11. The connector of claim 1 further including means for sliding the draw bar longitudinally.

12. The connector of claim 2 wherein said covering means and said base include latching means for releasably latching the two together.

13. The connector of claim 1 wherein the floor of the base contains a plurality of openings for inlet and outlet of cleaning and flushing agents.

14. The connector of claim 1 wherein the base includes projecting platforms at either end, said platforms providing leverage abuttments whereby the draw bar can be moved longitudinally by a screwdriver blade or the like inserted between an abuttment and an end of the draw bar.

15. The connector of claim 1 further including means on the base for limiting longitudinal travel of the draw bar and for preventing longitudinal travel of the actuator members.

16. A connector for receiving a multi-pin electronic device and electrically connecting such to a printed circuit board or the like, which comprises:

a. an elongated base member having a cavity with means therein to define a plurality of spring-member receiving spaces; said spaces being normal to the longitudinal axis of the base member and extending inwardly from either side thereof; further the base member having support means thereon;

b. a pair of parallel actuating members movably resting on said support means in overlying relation to said cavity, each actuating member having a base and a vertical wall along each side thereof with the inner surface of the wall nearest the adjacent actuating member having a repeating ramp and slot configuration thereon;

c. a plurality of conductive spring members each having a first arm and a second arm and a depending pin, said two arms being biased in abutting relation along a vertical section of each, said second arm being movable from said abutting relation with the first arm, said second arm having latching means thereon, said spring members being positioned in the spring-member receiving spaces in the base member cavity with the pins depending from the base member for insertion into a printed circuit board or the like and with the first arms adjacent a side wall of the base member and with the latching means on the second arms in latching relation with the overlying actuating member;

d. means positioned between said pair of actuating members and in overlying relation to the cavity and slidably movable along the length of the base, said means having depending walls with repeating ramp and slot configurations thereon, said walls extending into engaging cooperation with the ramp and slot-containing walls on the actuating members so that as the means slide longitudinally the actuating members move transversely, whereby in a transverse move inwardly away from the base member side walls, the outer vertical walls hook the latching means on the spring members and draws the second arm away from the first so that a multi-pin device may be easily inserted in between the two arms, and in a transverse move toward the side walls, the second arm returns to an abutting relation with the first arm so that the two arms embrace the pins of the device.

17. A connector for receiving a multi-pin electronic device and electrically connecting such to a printed circuit board or the like, which comprises:

a. a base member having an upwardly opening cavity adapted to receive a plurality of conductive spring members and support means;

b. at least one U-shaped actuating member resting on the support means in overlying relation to the cavity, and movable in a direction transverse to the longitudinal axis of the base member, said member having a repeating ramp and slot configuration on an inner surface of one vertical wall;

c. a plurality of conductive spring members each having depending pin on the lower end and on the upper end, a vertical first arm and a resilient S-shaped second arm with the upper curve thereon providing a latching means, said second arm being biased toward said first arm, said members being positioned in the cavity with the pins depending from the base member and the latching means on the second arm being latched to the actuating member;

d. means positioned over the cavity and adapted to be moved longitudinally relative to the base member, said means having at least one depending arm with a repeating ramp and slot configuration on a vertical inside surface, said arm extending into engaging cooperation with the ramp and slots on the actuating member so that as the means move longitudinally, the interaction of the cooperating ramp and slot configurations move the actuating member transversely whereby a move in one direction pulls the second arm away from the first so that a multi-pin device may be easily inserted in between the first and second arms and a move in the opposite direction permits the second arm to spring back toward the first arm so that a pin which may be between the two becomes electrically embrased thereby.

* * * * *